United States Patent [19]

Riello

[11] 4,067,204

[45] Jan. 10, 1977

[54] AIR CONDITIONER

[75] Inventor: Valerio Giordano Riello, Legnano (Verona), Italy

[73] Assignee: Riello Condizionatori di Giordano Riello & C. S.p.A., Bevilacqua (Verona), Italy

[21] Appl. No.: 732,185

[22] Filed: Oct. 13, 1976

[30] Foreign Application Priority Data

Apr. 21, 1976 Italy ..... 22496/76

[51] Int. Cl.[2] ..... F25D 23/12

[52] U.S. Cl. ..... 62/262

[58] Field of Search ..... 62/262

[56] References Cited

U.S. PATENT DOCUMENTS

| | | | |
|---|---|---|---|
| 2,062,042 | 11/1936 | Sargent | 62/262 |
| 2,789,494 | 4/1957 | Goettl et al. | 62/262 |
| 3,271,972 | 9/1966 | Knight | 62/262 |
| 3,296,820 | 1/1967 | Bauman | 62/262 |
| 3,635,046 | 1/1972 | Sato et al. | 62/262 |
| 3,665,726 | 5/1972 | Preotle | 62/262 |

*Primary Examiner*—Lloyd L. King

*Attorney, Agent, or Firm*—Wenderoth, Lind & Ponack

[57] ABSTRACT

An air conditioner for dwelling rooms or the like, of the type wherein two air flows are maintained in communication with the room inside and respectively with the outer atmosphere, in cooperation with one or two holes made in the shutter glass panes of a room window. Said air conditioner is installed out of the window, on the window sill, and is put in communication with the room inside through air flow ducts mating with said glass pane holes when the window inner shutters are closed, in order to reduce the air conditioner noise and allow a free inner shutter opening. The air conditioner is associated with an upper support for the edge of the window outer rolling shutter, as well as with lateral opaque panels in order to allow a complete room darkening without hindering the air conditioner operation.

7 Claims, 5 Drawing Figures

AIR CONDITIONER

BACKGROUND OF THE INVENTION

1. Field of the Invention

This invention relates to an air conditioner, suitable for conditioning and prevalently refrigerating enclosed environments, as e.g. dwelling rooms, offices and the like, such air conditioner, due to its particular installation and service conditions being more properly definable as an "out-of-window" air conditioner.

2. Description of the prior art

Similar room conditioning systems — usually called air conditioners — are already well known and widely utilized, so that a detailed description thereof is unnecessary. However, and within the limits of what may be of interest regarding the present invention, such air conditioners generally comprise two air circuits, each including inlet and outlet passages, as well as devices such as electric fans by which an air circulation across such passages is ensured. One pair of inlet and outlet passages, appertaining to one of the circuits, is in communication with the inner atmosphere of the room to be conditioned, while the passages appretaining to the other circuit are in communication with the outer atmosphere. Moreover, such air conditioners comprise a refrigerating system including a compressor, a condenser and an evaporator for a suitable fluid, that can be converted from its gaseous condition to its liquid condition at a relatively low temperature (usually a fluorine compound, e.g. a so called "Freon"). Since room refrigeration is the main purpose for which such systems are designed, the evaporator is placed into the air circuit between the inlet and the outlet passages in communication with the room, whilst the condenser is placed into the air circuit between the inlet and the outlet passages in communication with the outdoors. Thus, when the system is operated, heat is removed from the room and dissipated to the outside.

Such primary requirement to be met by an air conditioner results in the necessity to have the same so installed to ensure the required communication both with the interior of the room and the outside. When the air conditioners are designed for rooms having a relatively small cubic volume, as e.g. dwelling rooms, windows are utilized for such installation. When permanent or semi-permanent installations are provided for and when the window comprises a portion wherein the window shutters can be removed or not utilized, recourse may be made to air conditioners having a casing (wherein all components of the air conditioner are fitted) that is installed in such a manner as to partly protrude outwardly from the window. In other and very common cases, one or two openings are formed in the window shutter glass panes and are associated with intake and exhaust ducts of the air conditioner circuit communicating with the outside. Suitable sealing means (usually rings or packings of a suitable elastomer) are obviously provided for on such openings. In the latter case, the air conditioner casing is located wholly inside of the room and is preferably supported by movable stands or the like, to thereby allow for removal of the air conditioner when the service thereof is not required (e.g. during the cold season), while the openings in the window shutter glass panes are closed by suitable discoidal elements.

Obviously, when the air conditioner is installed, in order to open the window shutter units it is necessary to remove the air conditioner, since the window shutter units are of the type which are opened by turning or swinging inwardly toward the room.

Such removal operations are neither quick, nor simple and in case of installations in dwelling rooms, and in practice the air conditioner is permanently, or nearly permanently left in its service position and conditions, during the warm season. Moreover, when the outer sunlight is to be intercepted (e.g. when the conditioned room is a bed room) by closing the outer shutters, e.g. by completely lowering a rolled shutter, any possibility of utilizing the air conditioner is obviously excluded, since the free circulation of the outside air current across the conditioner is entirely prevented.

This represents a serious service restriction of such air conditioners which are entirely installed within a room. As a matter of fact the air conditioner prevents the free and frequent opening of the window units. It would be desirable to ensure a complete air renewal in the room and also to enjoy the psychological effects of natural air circulation, e.g. when the outside air is cooler such as at twilight and dawn, as well as to eliminate the feeling — disagreable for some people — of being in a room which is entirely closed from the outside.

A further heavy drawback of normal air conditioners, in particular when installed wholly inside of a room, is their unavoidable noise. Such drawback is felt in particular by those which want to sleep in a conditioned room. The utilization of a normal air conditioner for the refrigeration or at any rate the conditioning of a bed room typically results in the necessity of not being able to have the room entirely obscured or darkened by the outer shutters and leads to a permanent disadvantage caused by the noise of operating the conditioner.

SUMMARY OF THE INVENTION

Accordingly, an object of this invention is to provide an air conditioner wherein particular technical solutions are provided which allow the air conditioner to be installed entirely on the outside of the glass panes of a window shutter unit of the type wherein the window units are side hung and pivot inwardly during opening, without preventing the opening and closing thereof, and which transmit the majority of the noise of the air conditioner to the outside.

According to this invention, the air conditioner is installed above and secured to the window sill. A low opaque wall extends from opposite sides of the conditioner to the side edges of the window frame, through the entire height of the conditioner. Such wall forms a base support for the outer window shutter, usually a rolled shutter, so that the outer shutter, when lowered down onto the base support, will along with the opaque wall, completely shut out sunlight from the room, but will not interfere with the conditioner operation. To make installation easier and to ensure the best stability of the "out-of-window" air conditioner, this conditioner is designed in such a manner that all components thereof are circumscribed by and enclosed within an elongated casing having a very small horizontal size in a direction orthogonal to the plane of the window when closed. The resulting large horizontal size in a direction parallel to the plane of the window, is not disadvantageous (on condition that it is not longer than the width of the window). Further such large dimension makes it possible to have the inlet and outlet openings of both circuits widely spaced, thereby reducing or practically eliminating the possibility of direct mixing of the inlet and outlet flows.

The inlet and outlet ducts of the circuit including the evaporator, or at any rate of the circuit in communication with the room to be conditioned, obviously require orifices to be formed in the glass panes of the inner shutter units. Such ducts and orifices are fitted with suitable annular seals adapted to prevent air leakage when the window is closed, under conditions such that sealing occurs merely by completely closing the inner window shutter units, without any mechanical linkage, so that no preparatory operation is required when the window is to be opened or closed.

Accordingly, in order to connect the conditioner passages with the orifices in the window panes and to establish communication with the outside, in contrast with the known "inner" conditioners which must be advanced toward and against the window panes, the air conditioner according to this invention is installed in a practically stationary condition (even not excluding the removal thereof, if desired, when its operation is not required), and the engagement of the air conditioner passages (in communication with the room interior) occurs by merely swinging the inner window shutter units thereagainst, i.e. in practice by simply closing the window units.

DESCRIPTION OF THE PREFERRED EMBODIMENTS

Figure 1:
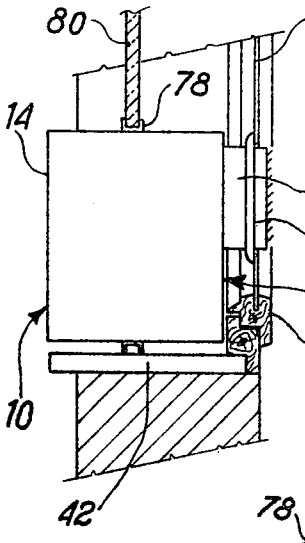
FIG. 1 is a fragmentary view, in an essentially diagrammatic section taken on a plane orthogonal to the plane of the closed window, and showing a typical installation of an air conditioner according to this invention.
Figure 2:
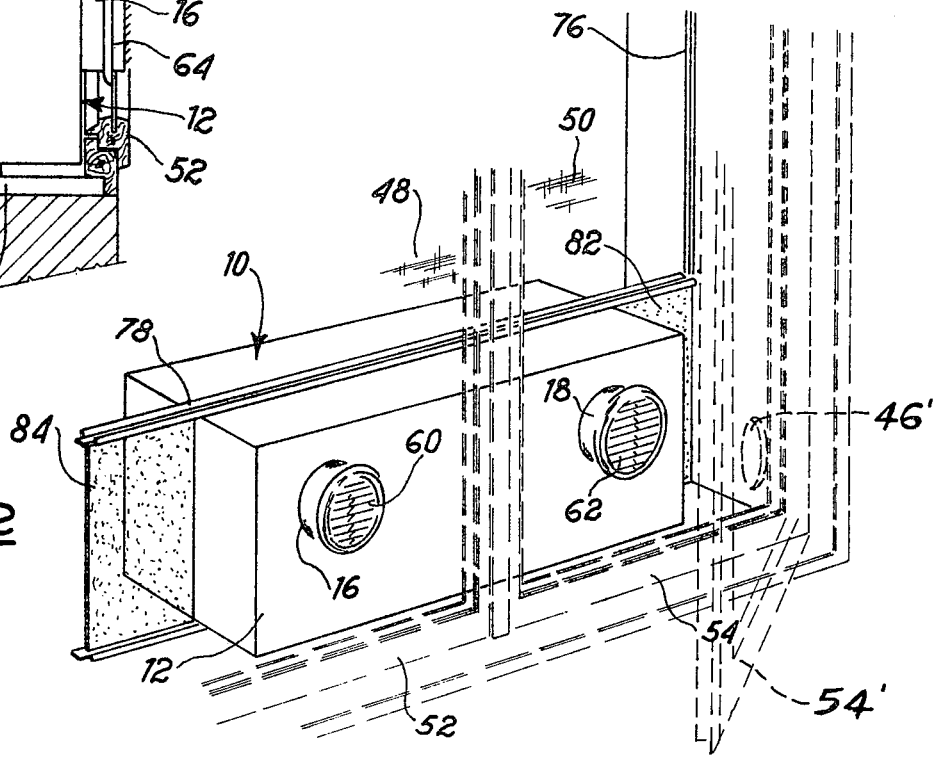
FIG. 2 is a fragmentary, perspective view of the air conditioner as viewed from the interior of the room.

The essential features of the air conditioner according to this invention can be inferred mainly from the examination of FIGS. 1 and 2. According to such figures, the air conditioner comprises, in accordance with conventional arrangements, a casing 10 having a fore wall 12 (directed toward the room interior and visible therefrom) and a rear wall 14, directed toward the outside. Fore wall 12 has openings 16 and 18, therein preferably in the form of short tube lengths, through which a communication is established with the room to be conditioned, while the rear wall is formed with further openings 20 and 22 (see FIGS. 3 and 4) through which the outdoor air is circulated, to thereby dissipate or absorb the heat of the room when the conditioner acts as a cooler (or as a heater) in a generally conventional manner.

Figure 3:
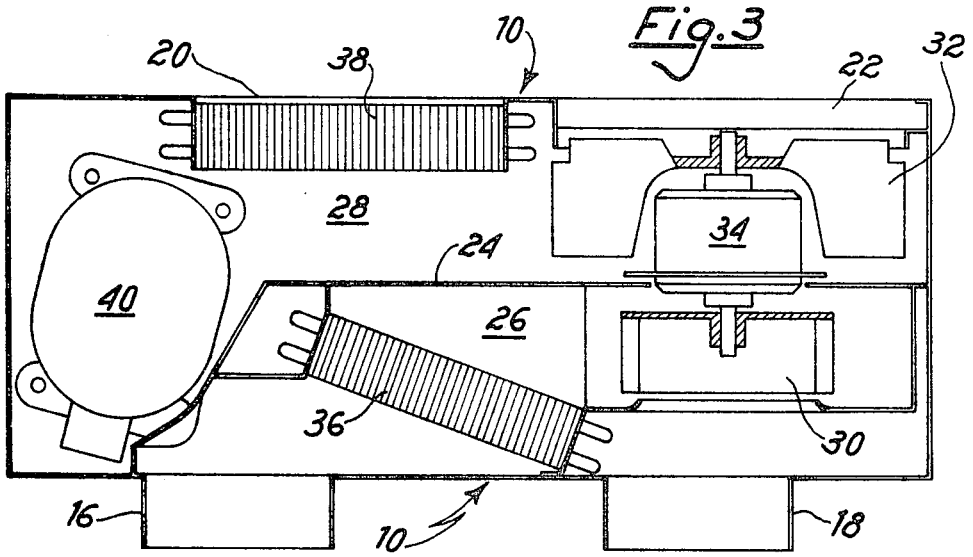
FIG. 3 is a plan view of one example of the construction of an air conditioner according to the invention with the upper cover removed.
Figure 4:
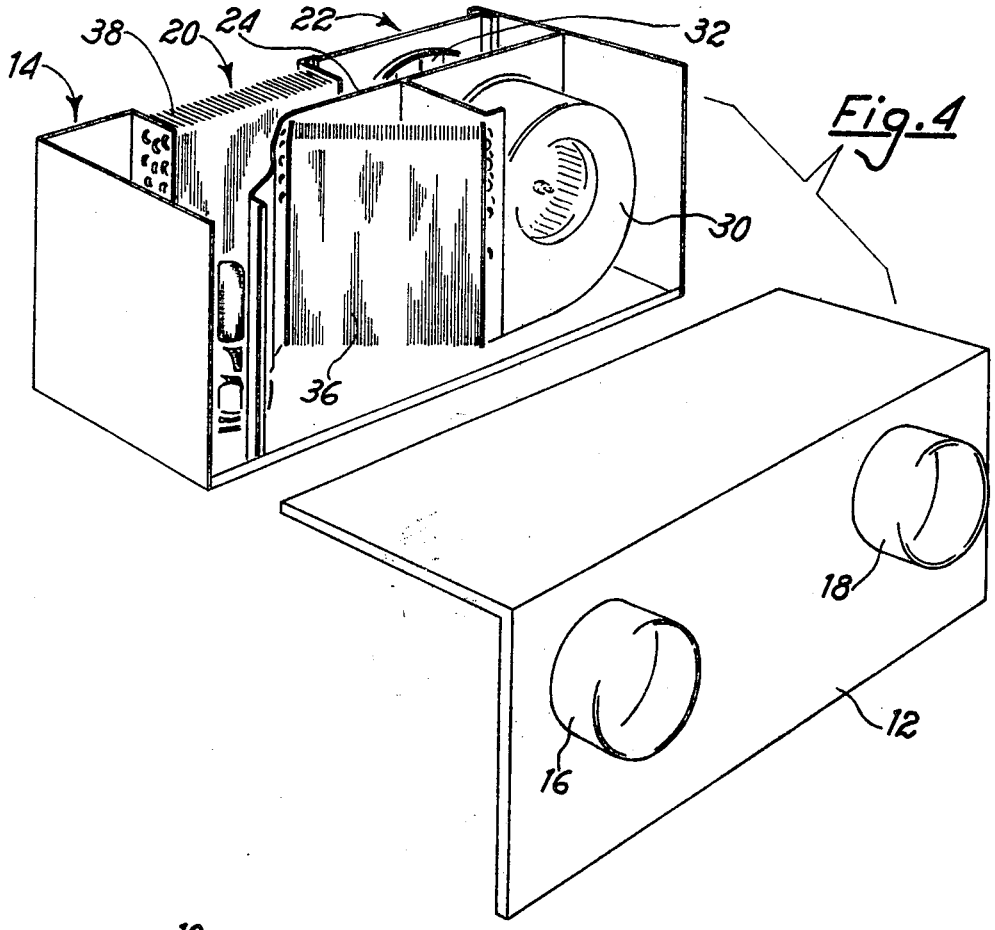
FIG. 4 is an exploded perspective view of the air conditioner structural components and operating assembly, with the cover thereof removed.

The pairs of openings 16,18 and 20,22 are independently placed in communication with interior spaces 26 and 28, respectively (see FIG. 3). Spaces 26 and 28 are separated, inside of casing 10, e.g. by a suitably shaped partition wall 24 (see FIGS. 3 and 4). Spaces 26 and 28 house conventionally known devices to ensure air circulation, e.g. in the form of coaxially arranged fans or centrifugal blowers 30 and 32, driven by a motor 34, as well as devices to transmit heat from the fluid flowing between the openings 16 and 18 to the fluid flowing between the openings 20 and 22. According to known technical solutions, along the paths of such fluids are a first heat exchanger 36 (an evaporator) and a second heat exchanger 38 (a condenser), which are operated by a conventional compressor unit 40.

FIG. 3 illustrates a preferred but not limiting example showing the arrangement and distribution of the essential refrigerating assembly components, within the casing 10, for the best adaptation thereof to the installation according to this invention.

In fact, taking into account that the space available for a typical out-of-window installation is that offered by a normal window-sill 42, it is advantageous that the installation have a relatively small overall size in a horizontal direction orthogonal to the plane of the closed window (in order to support the installation entirely on the projecting sill) and that the center of gravity of the entire installation be as close as possible to the window. The arrangement shown in FIG. 3 is particularly suitable for such a purpose, particularly because the compressor unit 40 (that represents the most heavy component) is located very close to the window.

The space which is available in the horizontal direction parallel to the window is usually very large, and therefore the casing 10 can advantageously be elongated in such direction, to thereby take the best advantage from such space availability. Conversely, it is advantageous to restrict, as far as possible, the vertical size of the casing, and to thereby avoid as much as possible the "visibility through the window and the passage of light through the window into the room.

Moreover, it is advantageous that the inlet and outlet openings for flow of air into and out of the room be widely spaced in order to prevent the mixing of air between such openings. The air conditioner arrangement and installation according to this invention make it possible to satisfy such requirement by exploiting practically the entire width of the window (usually a two pane window), and by forming openings or passages in both such glass panes.

In practice, a constructive solution of the this type makes it possible to advantageously obtain an air conditioner the entire operating assembly of which can be enclosed within a casing having a horizontal dimension parallel to the window plane not greater than 800 mm, a depth, i.e. a horizontal dimension orthogonal to the window plane of about 300 mm or slightly larger, and a vertical dimension or height of about 350 mm. Such dimensional values are obviously intended to be exemplary only and not restrictive, since changes may be made therein, according to space availability, air conditioner capacity and different installation and operation requirements.

At any rate, the air conditioner when installed and in operation is located entirely outside the room and is separated from the room to be conditioned by the closed window panes or units. This results in the advantage that the well known air conditioner noise is eliminated or at least greatly reduced, since the noise is mainly and freely spread to the outside.

Figure 5:
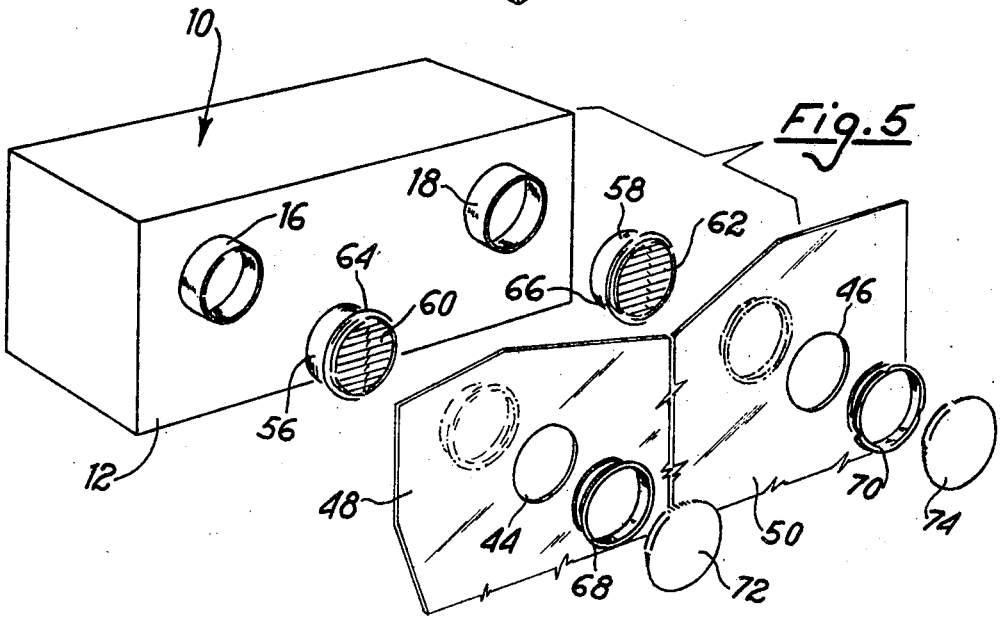
FIG. 5 is an exploded perspective view of the various elements of the invention required to associate the air conditioner with the window panes.

The communication between the inside of the room and the air conditioner is only that formed by the openings or orifices 44 and 46 (see FIG. 5) in the glass panes 48 and 50 of the two inner window shutters or units 52 and 54, respectively (see FIG. 2). Openings 44 and 46 are located in positions so as to strictly coincide with the air conditioner orifices 16 and 18, respectively, when the window units 52 and 54 are closed. To ensure such coincidence, along with a good seal against the possible escape of air, passages 16 and 18 are preferably associated with telescopically fitted tubular sleeves 56 and 58 (see FIG. 5), fitted with suitable interior grills 60 and 62, and surrounded by rings 64 and 66 of an elastomer material, by which substantially air-tight stops against the panes 48 and 50 are formed, without however unacceptably stressing panes 48 and 50. The openings 44 and 46 can in turn be fitted with packing rings 68 and 70, by which discs 72 and 74 can be retained to close the openings when the air conditioner is dismounted and not in use.

As it can be directly concluded from an examination of FIGS. 1 and 2, and taking into account that the window units 52 and 54 are side hung and are opened by turning or swinging toward the interior of the room, as shown at 54 ' in FIG. 2 the arrangement of the installation according to this invention results in the elimination of any need of removing or displacing the air conditioner to open or close the window.

Indeed, no obstacle is encountered when the inner window shutters or units 52 and 54 are to be opened, since such operation involves the mere opening of the window units to result in disengagement and withdrawal of openings 44 and 46 from the rings 64 and 66 with which the tubular sleeves 56 and 58 are fitted, for example as shown at 46' in FIG. 2, while the air conditioner is firmly retained and remains in its installed position. Thereafter, by wholly closing of the inner window shutters by swinging units 52 and 54 to the position shown in FIG. 2, the air conditioner is again brought back to its operating condition, as shown in FIGS. 1 and 2, thus reestablishing the limited communication between the interior of the room and the circuit associated with the passages 16 and 18.

Obviously the installation, as shown in FIGS. 1 and 2, prevents a complete lowering of the normal outer shutters conventionally employed for darkening the room. Such shutters 80 are typically in the form of rolling shutters or Venetian blinds the opposite edges of which are retained by lateral U-shaped guides 76. When an air conditioner as shown is installed on the window-sill 42, the U-shaped guides 76 are preferably connected with one another by a crosswise extending element, e.g. a U-shaped guide 78, acting as lower rest for the outer rolling shutter 80 (see FIG. 1) when entirely lowered. Guide 78 also acts as a further structural support for firmly securing the air conditioner in place on the underlying window sill 42.

Due to reasons of constructional standardization, the air conditioner length is normally made smaller than the width of standard windows. The spaces that are thus left free on opposite sides of the air conditioner can then be closed by transparent or preferably dark colored, or even opaque panels 82,84, to ensure a complete darkening of room when the outer rolling shutter 80 or the like is completely lowered (see FIG. 2), without impairing the proper operation and service of air conditioner, since passages 16 and 18 are always kept in communication with the room, while passages 20 and 22 are always widely exposed to the outer atmosphere. Such possibility, in combination with the reduced noise, makes it possible to use the air conditioner (suitably adjusted at low operating conditions) for conditioning at night a bed room, or at any rate rooms that are to be darkened.

Obviously, the air conditioner is to be associated with suitable conductors, as well as with feeding and control means. In order to avoid any installation operation that may interfere with the operation of the inner window shutter units, the air conditioner can be fed by a power cable that extends from the room to be conditioned into the interior of the conditioner unit, e.g. through one of passages 16 and 18, such cable being of a flexible type and having a length sufficient to prevent any interference with the opening and closing operation of the inner window units. Operating, control and adjusting devices (switches, knobs and the like) can be fitted on one of passages 16 and 18, e.g. in spaces provided in grills 60 and 62, or even on the power cable. Obviously, when safety rules and requirements are complied with, the feeding and controls can be fitted inside of the room, and are then connected with the air conditioner, e.g. by suitably shielded cables that are passed through the stationary window frame.

It is to be understood that many changes and modifications may be made to the above disclosed preferred embodiment, without departing from the spirit and scope of the present invention.

I claim:

1. In an assembly of the type including a window frame in a wall dividing an interior room from the exterior, said window frame having a substantially horizontally extending window sill and substantially vertically extending opposite frame edges, at least one inner window unit having a substantially vertically extending side pivotally mounted to one of said vertical frame edges of said window frame at a position thereon adjacent the side thereof closest to said interior room, said inner window unit being pivotable about a substantially vertical axis, in a direction inwardly toward said interior room, from a closed position extending in a plane parallel to and closing said window frame to an open position extending non-parallel to and spaced from said window frame, and an air conditioner supported by said window frame for conditioning the air in said interior room, the improvement wherein:

said entire air conditioner is supported and positioned at a location exterior of said interior room and exterior of said plane of said inner window unit when said inner window unit is in said closed position;

said air conditioner having inlet and outlet openings facing said interior room for removing and introducing flows of air into said interior room, said inlet and outlet openings being positioned to open into said plane of said inner window unit when said inner window unit is in said closed position; and said inner window unit having therein orifices, said orifices being dimensioned and positioned to coincide and align with said inlet and outlet openings of said air conditioner when said inner window unit is in said closed position, thereby providing communication between said interior room and said inlet and outlet openings, and whereby said inner window unit may be opened and closed without the necessity of removal or realignment of any components of said air conditioner.

2. The improvement claimed in claim 1, wherein said air conditioner includes an operating assembly enclosed within a casing having a substantially parallelepipedon configuration, said casing being supported above and attached to said window sill at a position exterior of said plane of said inner window unit when said inner window unit is in said closed position, said casing having spaced major sides which extend substantially parallel to said plane of said inner window unit when said inner window unit is in said closed position, a first major side being positioned closer to said inner window unit than a second said major side, said major side having therein said inlet and outlet openings, and said second major side having therein an exterior inlet and an exterior outlet which are completely exposed to said exterior.

3. The improvement claimed in claim 2, wherein the components of said operating assembly of said air conditioner are positioned within said casing such that the center of gravity of said air conditioner is located at a position above said window sill and closely adjacent said plane of said inner window unit when said inner window unit is in said closed position.

4. The improvement claimed in claim 1, further comprising an outer shutter supported from the top of said window frame and lowerable therefrom to extend in a plane parallel to and outwardly spaced from said plane of said inner window unit when said inner window unit is in said closed position, and base support means positioned on the top of said air conditioner for supporting and defining the lowest position of the lower edge of said outer shutter when said outer shutter is lowered.

5. The improvement claimed in claim 4, wherein there are spaces between opposite sides of said air conditioner and said vertical frame edges of said window frame, and further comprising panels filling said spaces, said panels having limited transparency to sunlight.

6. The improvement claimed in claim 1, including two inner window units, one each of said inner window units being pivotally mounted about a vertical axis to a respective one of said vertical frame edges of said window frame, each of said inner window units having therein a single said orifice.

7. The improvement claimed in claim 1, wherein said inlet and outlet openings are defined by short length tubes extending from said air conditioner, said tubes each having coaxially mounted thereabout an annular seal means for sealingly contacting said inner window unit when said inner window unit is in said closed position.

* * * * *

UNITED STATES PATENT AND TRADEMARK OFFICE

CERTIFICATE OF CORRECTION

PATENT NO. : 4,067,204

DATED : January 10, 1977

INVENTOR(S) : VALERIO GIORDANO RIELLO

It is certified that error appears in the above-identified patent and that said Letters Patent are hereby corrected as shown below:

Change the date of issue of the patent from

"January 10, 1977" to -- January 10, 1978 --.

Signed and Sealed this

*Fourth* Day of *July 1978*

[SEAL]

*Attest:*

RUTH C. MASON
*Attesting Officer*

DONALD W. BANNER
*Commissioner of Patents and Trademarks*